US006334763B2

(12) United States Patent
Yuzaki et al.

(10) Patent No.: US 6,334,763 B2
(45) Date of Patent: Jan. 1, 2002

(54) CAPACITY-CONTROLLED SCROLL-TYPE COMPRESSOR HAVING INTERNALLY-BYPASSING SYSTEM

(75) Inventors: Tsuneo Yuzaki; Minoru Kawada, both of Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/878,961

(22) Filed: Jun. 13, 2001

Related U.S. Application Data

(62) Division of application No. 09/212,861, filed on Dec. 17, 1998.

(30) Foreign Application Priority Data

Dec. 18, 1997 (JP) ..... 9-363832
Dec. 18, 1997 (JP) ..... 9-363833
Dec. 18, 1997 (JP) ..... 9-363834

(51) Int. Cl.[7] ..... F04C 18/04
(52) U.S. Cl. ..... 418/55.2; 417/310
(58) Field of Search ..... 417/304, 308, 417/310; 418/55.1, 55.2

(56) References Cited

U.S. PATENT DOCUMENTS 4,457,674 A * 7/1984 Kawano et al. ..... 418/55.2 X
4,472,120 A * 9/1984 McCullough ..... 418/55.2 X
4,824,343 A * 4/1989 Nakamura et al. ..... 418/55.1
5,015,163 A * 5/1991 Iizuka ..... 418/55.2
5,248,244 A 9/1993 Ho et al. ..... 417/292
5,421,707 A * 6/1995 Daniels ..... 418/55.2
5,496,161 A * 3/1996 Machida et al. ..... 418/55.2
5,632,612 A 5/1997 Shaffer ..... 418/55.4
5,857,844 A * 1/1999 Lifson et al. ..... 418/55.2 X
5,951,270 A * 9/1999 Dumoulin et al. ..... 418/55.2

FOREIGN PATENT DOCUMENTS

JP 59-176483 * 10/1984 ..... 418/55.2
JP 4-325791 * 11/1992 ..... 418/55.2

* cited by examiner

*Primary Examiner*—Tony M. Argenbright
(74) *Attorney, Agent, or Firm*—Oblon, Spivak, McClelland, Maier & Neustadt, P.C.

(57) ABSTRACT

A capacity-controlled scroll-type compressor having an internally-bypassing system is provided, by which it is possible to prevent the tip gaps near the gas-suction inlet or the main stream of bypassing gas from becoming smaller than those of other portions. Regarding tip gaps near the gas-suction inlet, the length of teeth of a portion of the scrolls, which is closer to the gas-suction inlet, is shorter than teeth of other portions of the scrolls. Regarding tip gaps near the main stream of a bypassing gas, (i) the length of teeth of a portion of the scrolls, which is close to the main stream of a bypassing gas, is shorter than teeth of other portions, or (ii) a gas-suction inlet is positioned near the main stream of bypassing gas so as to suppress increase in the temperature of an area neighboring the main stream.

4 Claims, 6 Drawing Sheets

CAPACITY-CONTROLLED SCROLL-TYPE COMPRESSOR HAVING INTERNALLY-BYPASSING SYSTEM

This application is a division of application Ser. No. 09/212,861 filed Dec. 17, 1998.

BACKGROUND OF THE INVENTION

1. Field of the Invention

The present invention relates to a capacity-controlled scroll-type compressor having an internally-bypassing system.

This application is based on patent applications Ser. Nos. Hei 9-363832, Hei 9-363833, and Hei 9-363834 filed in Japan, the contents of which are incorporated herein by reference.

2. Description of the Related Art

In conventional capacity-controlled scroll-type compressors having an internally-bypassing system, when the capacity of the compressor is controlled, a temperature difference occurs between an area through which higher-temperature bypassing gas passes and another area through which lower-temperature suction gas passes. Therefore, a gap at a tip provided on the head of each tooth near a gas-suction inlet tends to decrease and thus scuffing occurs.

On the other hand, when the capacity of the compressor is controlled, the temperature of a portion of scrolls, which is close to the main stream of higher-temperature bypassing gas, is higher than the temperature of other portions. Therefore, the teeth of the higher-temperature portion is extended, thereby decreasing a gap at a tip of the teeth and also generating scuffing in this case.

SUMMARY OF THE INVENTION

An object of the present invention is to solve the above problem related to scuffing due to decrease of such a tip gap.

Therefore, the present invention provides a capacity-controlled scroll-type compressor having an internally-bypassing system, the compressor comprising a housing, scrolls, and a gas-suction inlet, wherein the gas-suction inlet is positioned at the low-pressure side inside the housing; and the length of teeth of a portion of the scrolls, which is closer to the gas-suction inlet, is shorter than teeth of other portions of the scrolls.

According to this structure, when the capacity is controlled, it is possible to prevent the tip gaps near the gas-suction inlet from becoming smaller than those of other portions; thus, scuffing can be prevented between the heads of the target spiral lap and the inner surface of an end plate in the compressor.

The present invention also provides a capacity-controlled scroll-type compressor having an internally-bypassing system, the compressor comprising scrolls, wherein the length of teeth of a portion of the scrolls, which is close to the main stream of a bypassing gas, is shorter than teeth of other portions.

According to this structure, when the capacity is controlled, it is possible to prevent the tip gaps near the main stream of a bypassing gas from becoming smaller than those of other portions; thus, scuffing can be prevented between the heads of the target spiral lap and the inner surface of an end plate in the compressor.

In the above structures, the target portion for shortening the teeth may be of a hardening-processed scroll of the above scrolls The present invention also provides a capacity-controlled scroll-type compressor having an internally-bypassing system, the compressor comprising a gas-suction inlet positioned near the main stream of a bypassing gas so as to suppress increase in the temperature of an area neighboring the main stream of the bypassing gas.

Also in this arrangement, when the capacity is controlled, it is possible to prevent the tip gaps near the main stream of a bypassing gas from becoming smaller than those of other portions; thus, scuffing can be prevented between the heads of the target spiral lap and the inner surface of an end plate in the compressor.

DESCRIPTION OF THE PREFERRED EMBODIMENTS

Figure 1:
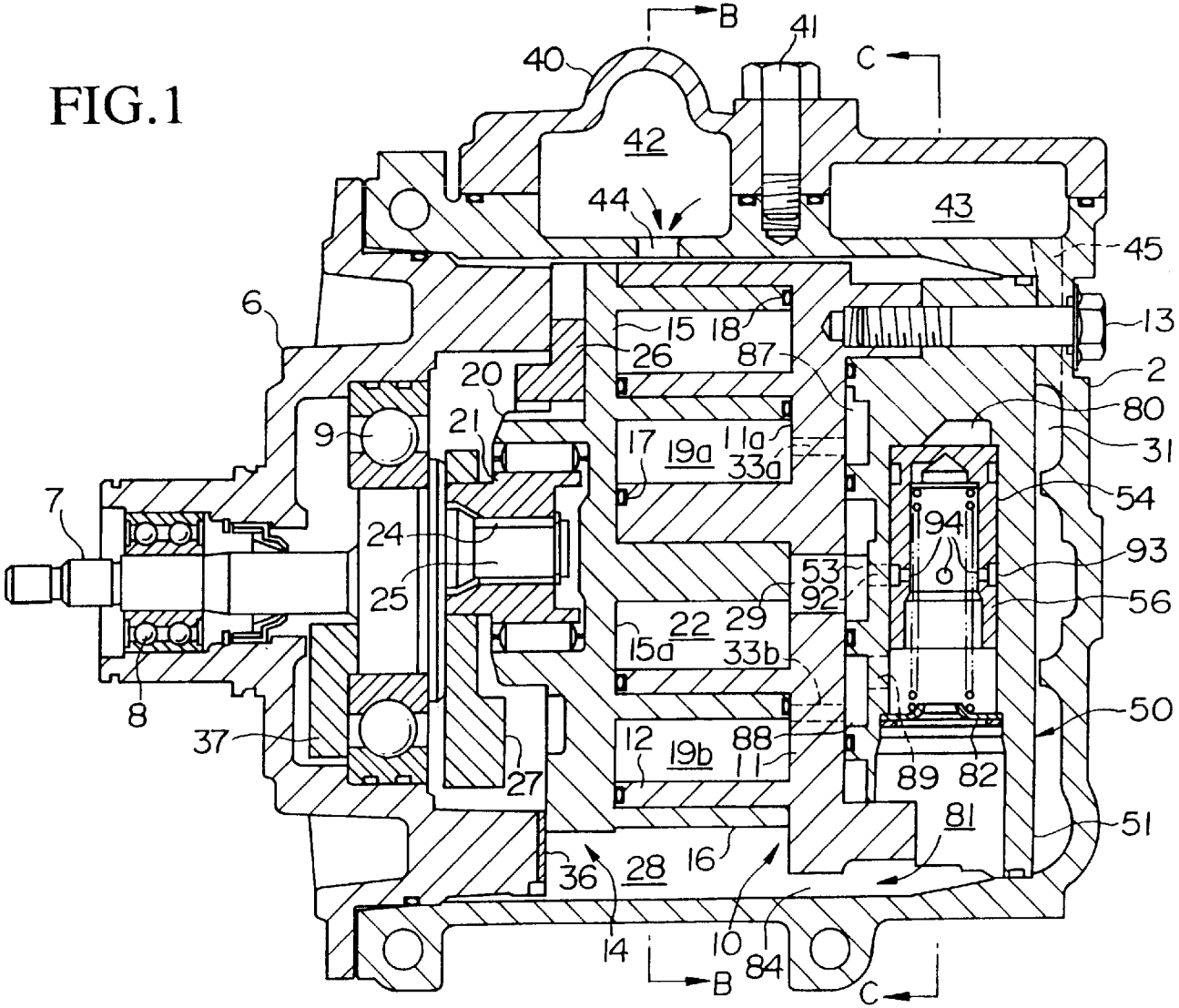
FIG. 1 is a sectional view in the longitudinal direction, showing a scroll-type compressor as the first embodiment according to the present invention.
Figure 2:
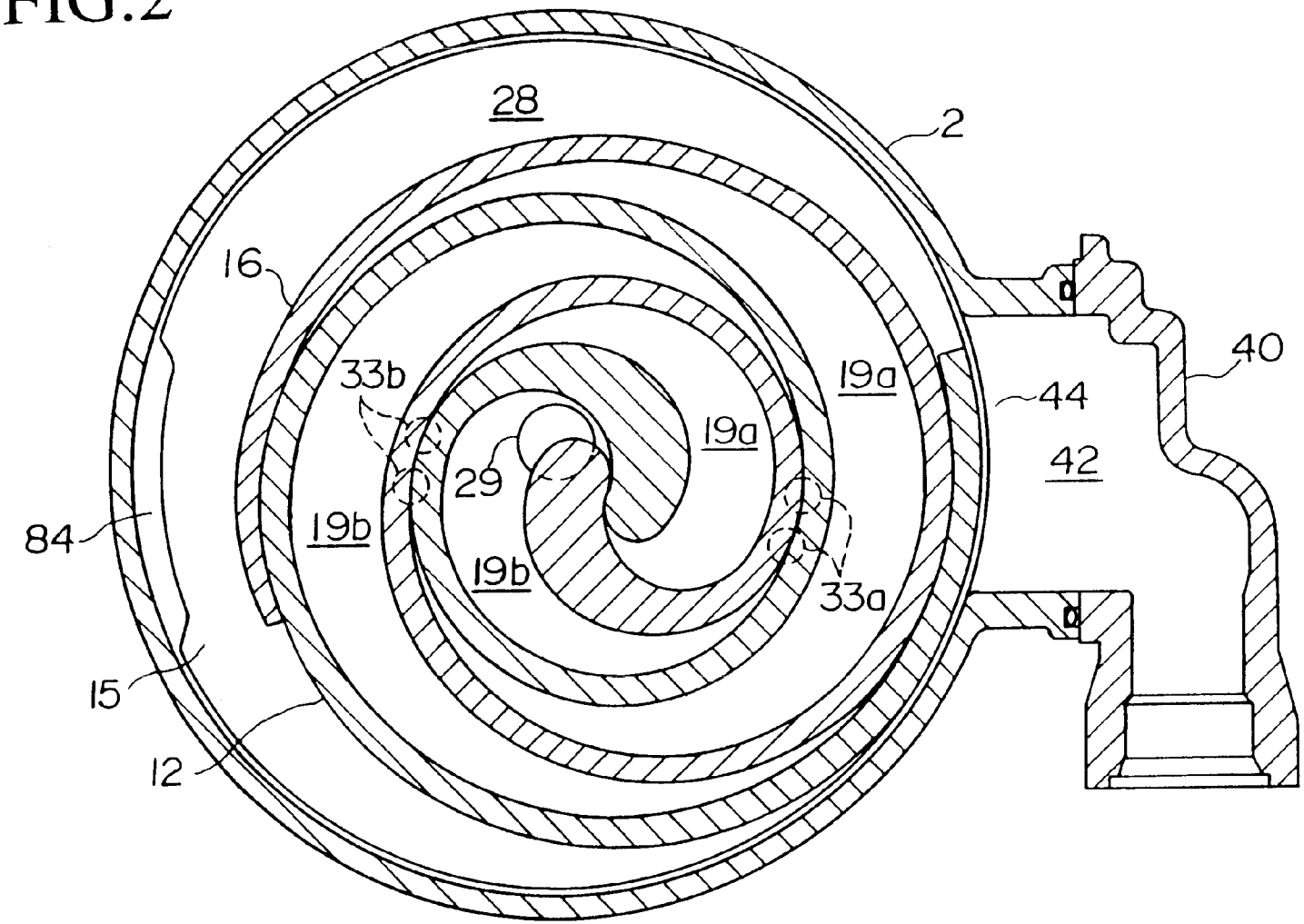
FIG. 2 is a sectional view along line "B—B" in FIG. 1.
Figure 3:
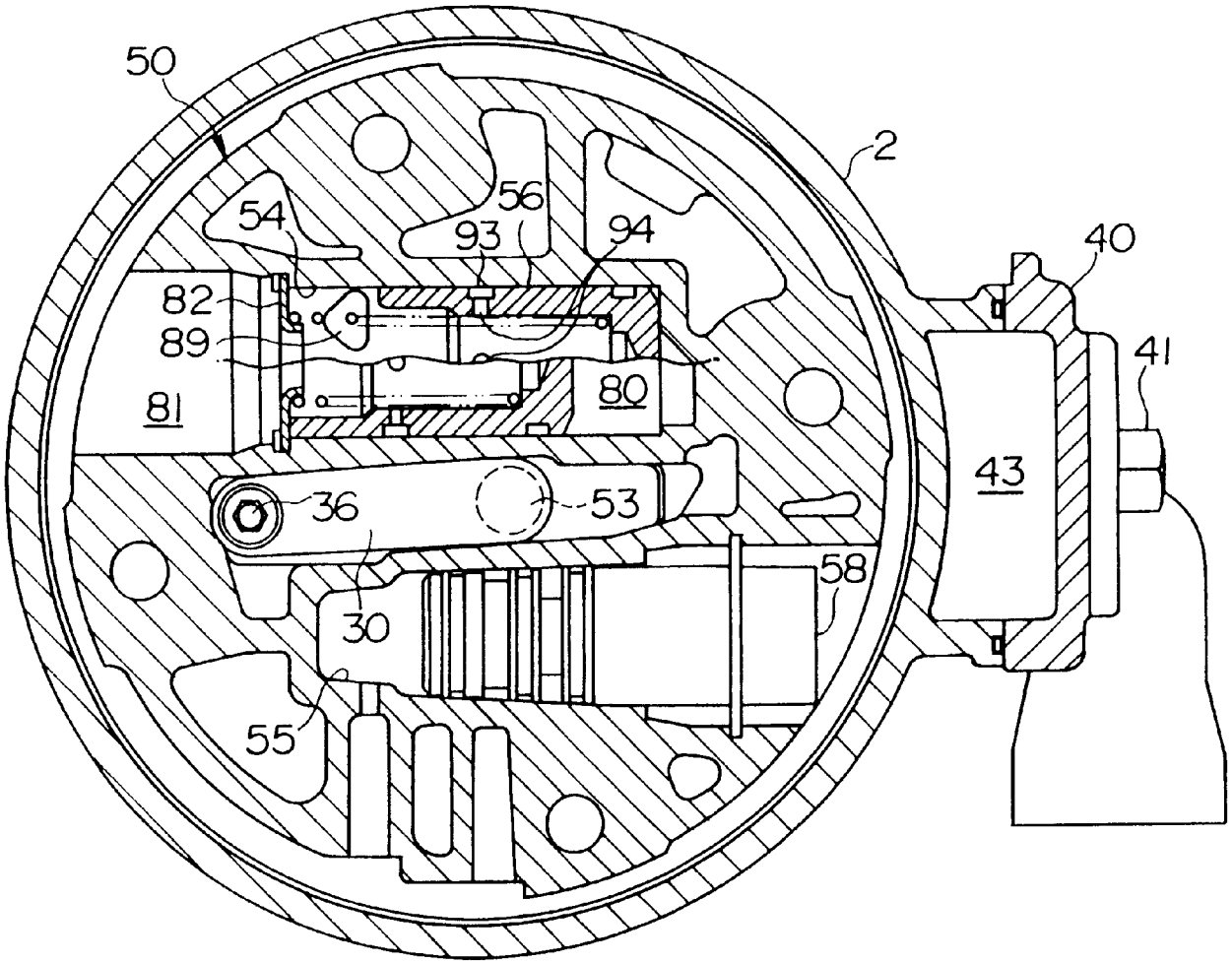
FIG. 3 is a sectional view along line "C—C" in FIG. 1.

The first embodiment of the present invention is shown in FIGS. 1-3. FIG. 1 is a sectional view in the longitudinal direction, FIG. 2 is a sectional view along line "B—B" in FIG. 1, and FIG. 3 is a sectional view along line "C—C" in FIG. 1.

In FIG. 1, reference numeral 1 indicates a housing which comprises cup-like main body 2, and front housing 6 fastened to the body 2 using a bolt (not shown). Rotational shaft 7 is supported by the front housing 6 via bearings 8 and 9, in a freely rotatable relationship.

Fixed scroll 10, revolving scroll 14, and capacity-control block 50 are provided inside the housing 1. This fixed scroll 10 comprises end plate 11 and spiral lap 12 disposed on inner surface 11*a* of the plate 11, and the surface faces end plate 15. The revolving scroll 14 comprises the end plate 15 and spiral lap 16 which is disposed on inner surface 15*a* of the plate 15, and the surface faces the end plate 11.

Inside projecting disk-shaped boss 20, provided at a center area in the outer surface (opposite to inner surface 15*a*) of end plate 15 of revolving scroll 14, drive bush 21 is inserted in a freely rotatable state via revolving bearing 23. Slide hole 24 is provided in the drive bush 21, and eccentric drive pin 25 is inserted into the slide hole 24 so as to perform a freely-sliding motion of the pin. The projecting drive pin 25 is eccentrically provided on an end face of larger-diameter portion 7*a* of rotational shaft 7, the portion 7*a* being provided on an end of the main body 2 side of the rotational shaft 7.

The axes of the revolving and fixed scrolls 14 and 10 are separated from each other by a predetermined distance, that is, they are in an eccentric relationship, as shown in FIG. 2. In addition, the phases of these scrolls differ by 180°, and they are engaged with each other.

Accordingly, as shown in FIG. 1, tip seals 17, provided and buried at each head surface of spiral lap 12, are in close contact with surface 15*a* of end plate 15, while tip seals 18, provided and buried at each head surface of spiral lap 16, are in close contact with surface 11*a* of end plate 11. The side faces of spiral laps 12 and 16 make linear contact at plural positions and thus plural compression chambers 19*a* and 19*b* are formed essentially at positions of point symmetry with respect to the center of the spiral, as shown in FIG. 2.

Also as shown in FIG. 2, a central part of end plate 11 is bored to provide discharge port 29, and a pair of bypassing ports 33*a* and 33*b*, joined with compression chambers 19*a* and 19*b* during compression, are provided.

In addition, the capacity-control block 50 is arranged in a manner such that this block is in close contact with the outer surface of end plate 11, thereby limiting concave areas 87 and 88. The head of screwing bolt 13 which passes through the capacity-control block 50 and the cup-like main body 2 is inserted into end plate 11 of the fixed scroll 10, thereby fastening the fixed scroll 10 and the capacity-control block 50 to the cup-like main body 2.

The outer-peripheral surface of flange 51 arranged at the outer end of the capacity-control block 50 is in close contact with the inner surface of the cup-like main body 2, thereby dividing the inside of housing 1 into plural chambers. That is, discharge cavity 31 is limited at the outside of flange 51, while low-pressure chamber 28 is limited at the inside of the flange 51.

As shown in FIG. 3, at a central area of capacity-control block 50, discharge hole 53 joined with discharge port 29 is provided, and opening/closing operations of this hole 53 is performed using discharge valve 30 which is attached to the outer surface of capacity-control block 50 via bolt 36.

Cylinder 54 like a blind opening is provided at one side of discharge hole 53, and blind opening 55 is provided at the other side, in parallel with the cylinder 54.

By inserting cup-like piston 56 into cylinder 54 in a closed and freely-sliding state, control pressure chamber 80 is limited at the side of the inner end of piston 56 while chamber 81 is limited at the other side. This chamber 81 is joined with suction chamber 28.

In cylinder 54, connection hole 92 joined with discharge hole 53 and connection hole 89 joined with concave area 88 are provided.

The piston 56 is forced toward control pressure chamber 80 by coil spring 83 which is inserted between the piston and spring bearing 82.

A circular groove 93, arranged along the outer-peripheral surface of piston 56, is linked with chamber 81 via plural holes 94 in any operational state.

On the other hand, control valve 58 is inserted into the opening 55. This control valve 58 senses a high pressure inside the discharge cavity 31 and a low pressure inside the low-pressure chamber 28, and generates a control pressure in accordance with the sensed pressure.

As shown in FIG. 1, between the peripheral edge of the outer surface of end plate 15 of revolving scroll 14 and an inner end face of front housing 6, thrust bearing 36 and Oldham link 26 are inserted.

In order to balance a dynamically unbalanced situation due to a revolving motion of the revolving scroll 14, balance weight 27 is attached to drive bush 21, and balance weight 37 is attached to the rotational shaft 7.

In addition, piping fitting 40 is fastened to an upper portion of cup-like main body 2 via bolt 41, and gas-suction path 42 and gas-discharge path 43 are limited between the piping fitting 40 and the outer-peripheral surface at the upper side of the cup-like main body 2.

This gas-suction path 42 is joined with low-pressure chamber 28 via gas-suction inlet 44, and the gas-discharge path 43 is joined with the discharge cavity 31 via hole 45.

Accordingly, at the time of a full-loading operation of the compressor, when the rotational shaft 7 is rotated, revolving scroll 14 is driven via eccentric drive pin 25, slide hole 24, drive bush 21, revolving bearing 23, and boss 20. The revolving scroll 14 revolves along a circular orbit, while rotation of the scroll 14 is prohibited by the Oldham link 26.

In this way, the line-contact portions in the side faces of spiral laps 12 and 16 gradually move toward the center of the "swirl", and thereby compression chambers 19*a* and 19*b* also move toward the center of the swirl while the volume of each chamber is gradually reduced.

Accordingly, gas, which has flowed into low-pressure chamber 28 through gas-suction path 42 and gas-suction inlet 44, enters from an opening which is limited by the outer peripheral edges of spiral laps 12 and 16 to compression chambers 19*a* and 19*b*. This gas is gradually compressed and reaches central chamber 22. From the central chamber, the gas passes through discharge port 29 and discharge hole 53, and presses and opens discharge valve 30, and thereby the gas is discharged into discharge cavity 31. The gas is then discharged outside via hole 45 and gas-discharge path 43.

At the time of a non-loading operation of the compressor, a low pressure for control is generated via the control valve 58. When this control pressure is introduced into control pressure chamber 80, piston 56 receives the restoring force of coil spring 83 and is forced and positioned as shown in FIG. 1.

In this way, gas during compression in compression chambers 19*a* and 19*b* is introduced via bypassing ports 33*a* and 33*b*, concave areas 87 and 88, and connection hole 89, into chamber 81. On the other hand, the gas after compression is introduced from central chamber 22 via discharge port 29, discharge hole 53, connection hole 92, groove 93, and holes 94, into the chamber 81. Both flows of gas meet in chamber 81, and merged gas flows through groove 84, formed by cutting a portion of the outer peripheral surface of end plate 11 of the fixed scroll 10, into low-pressure chamber 28.

At the time of a full loading operation of the compressor, a high pressure for control is generated using control valve 58. When this control pressure is introduced into the control chamber 80, piston 56 moves back against the impact-resilience force of coil spring 83 and the outer end of the piston comes into contact with spring bearing 82. Accordingly, both connection holes 89 and 92 are closed by piston 56.

On the other hand, when in an operation mode for controlling (or reducing) capacity, a control pressure corresponding to a desired reducing ratio is generated using control valve 58. When this control pressure acts on the inner end face of piston 56 via control chamber 80, piston 56 is positioned where the pressing force due to the control pressure and the impact-resilience force by the coil spring 83 are balanced.

Therefore, under conditions of lower control pressure, only connection hole 89 is open, and a portion of the gas during compression in compression chambers 19*a* and 19*b* is discharged into low-pressure chamber 28 according to the degree of opening of the connection hole 89.

In addition, the connection hole 92 is gradually opened in accordance with increase of the control pressure. The degree of opening of the hole 92 is thus increased, and when the hole 92 is fully opened, the capacity of the compressor becomes zero.

At the time of a non-loading operation of the compressor, that is, When the capacity is controlled, a high-temperature bypassing gas flows through chamber 81 of cylinder 56 into low-pressure chamber 28. Therefore, the temperature of an area neighboring the main stream of the bypassing gas, that is, the temperature of a lower portion of the cup-like main body 2, is increased, while the low temperature of an area neighboring the gas-suction inlet 44, into which low-temperature suction gas flows, that is, the temperature of an upper portion of the cup-like main body 2, is maintained. Therefore, a temperature difference occurs in the cup-like main body 2, and accordingly, a difference of thermal expansion occurs.

Here, the fixed scroll 10 is fixed to the cup-like main body 2. Therefore, if a thermal-expansion difference occurs there, the gap between the head of a portion of spiral lap 12 near the gas-suction inlet 44 and the inner surface 15*a* of end plate 15, and also the gap between the head of a portion of spiral lap 16 near the gas-suction inlet 44 and the inner surface 11*a* of end plate 11, that is, "tip gaps" of such portions become smaller than those of other portions.

Therefore, in the present invention, the length (of the teeth) of such a portion of spiral lap 12 of fixed scroll 10 and/or the length (of the teeth) of such a portion of spiral lap 16 of revolving scroll 14 positioned near the gas-suction inlet 44 are shorter than those of other portions by approximately 20 $\mu$m. This setting is suitably performed within approximately 90°.

Accordingly, when the capacity is controlled, it is possible to prevent the tip gaps near the gas-suction inlet 44 from becoming smaller than those of other portions; thus, scuffing can be prevented between the head of spiral lap 12 and the inner surface 15*a* of end plate 15, and also between the head spiral lap 16 and the inner surface 11*a* of end plate 11.

Also when the capacity is controlled and a high-temperature bypassing gas flows through chamber 81 of cylinder 56 into low-pressure chamber 28, the temperature of portions of spiral laps near the flow of bypassing gas is increased and the portions thermally expand. Accordingly, the gap between the head of a portion of spiral lap 12 near the gas-suction inlet 44 and the inner surface 15*a* of end plate 15, and also the gap between the head of a portion of spiral lap 16 near the gas-suction inlet 44 and the inner surface 11*a* of end plate 11, that is, "tip gaps" of such portions become smaller than those of other portions.

Therefore, also regarding these portions, the length (of the teeth) of such a portion of spiral lap 12 of fixed scroll 10 and/or the length (of the teeth) of such a portion of spiral lap 16 of revolving scroll 14 positioned near the main stream of the bypassing gas are shorter than those of other portions by approximately 20 $\mu$m. This setting is suitably performed within approximately 90°.

Accordingly, when the capacity is controlled, it is possible to prevent the tip gaps near the main stream of the bypassing gas from becoming smaller than those of other portions; thus, scuffing can be prevented between the head of spiral lap 12 and the inner surface 15*a* of end plate 15, and also between the head spiral lap 16 and the inner surface 11*a* of end plate 11.

Preferably, regarding the above two cases, in order to realize necessary dimensional tolerance, if the inner surface of the end plate of one of the fixed and revolving scrolls 10 and 14, and the outer surface of the relevant spiral lap are subjected to a surface-hardening process, the target teeth of the surface-hardened spiral lap are made shorter.

Figure 4:
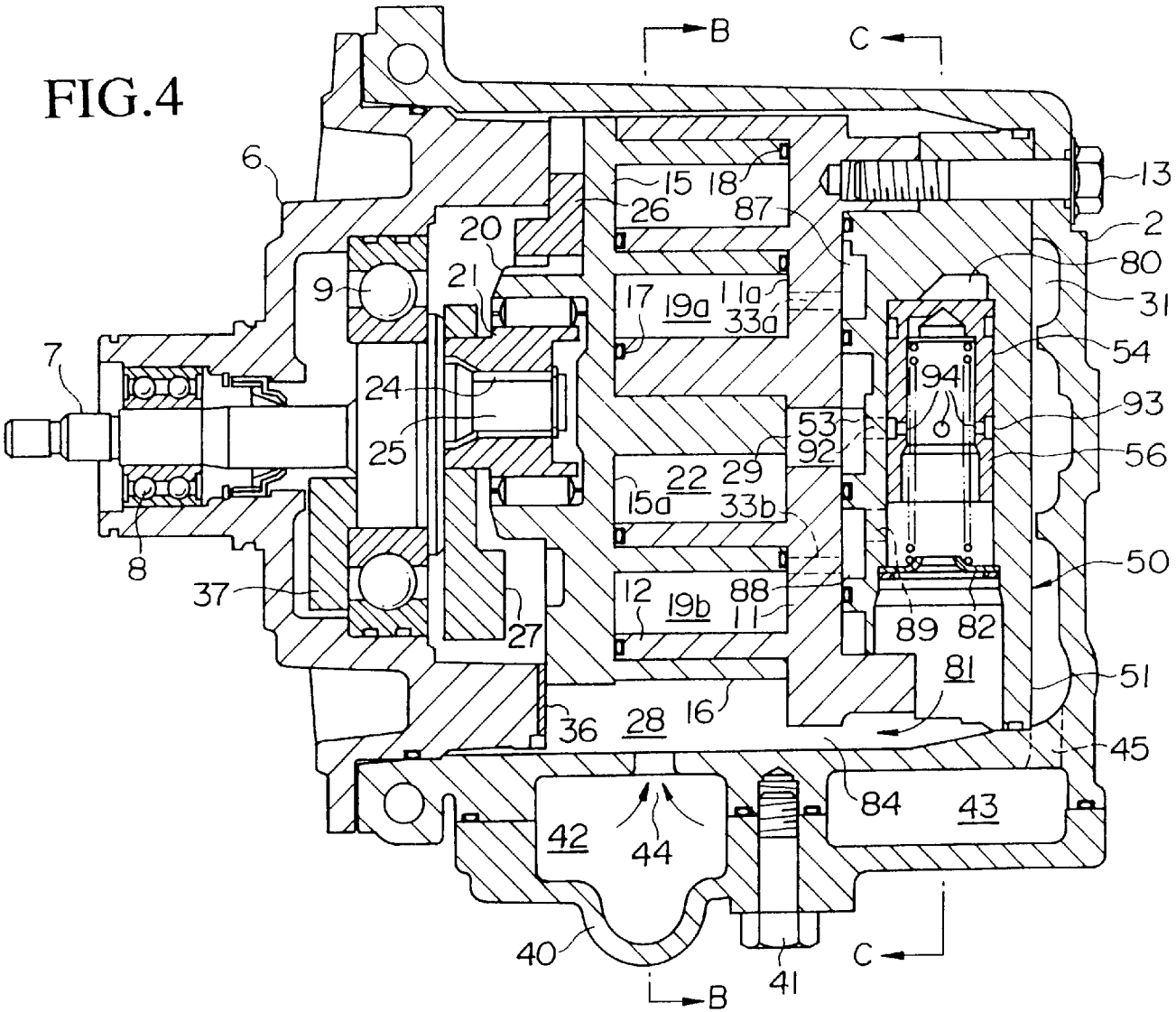
FIG. 4 is a sectional view in the longitudinal direction, showing a scroll-type compressor as the second embodiment according to the present invention.
Figure 5:
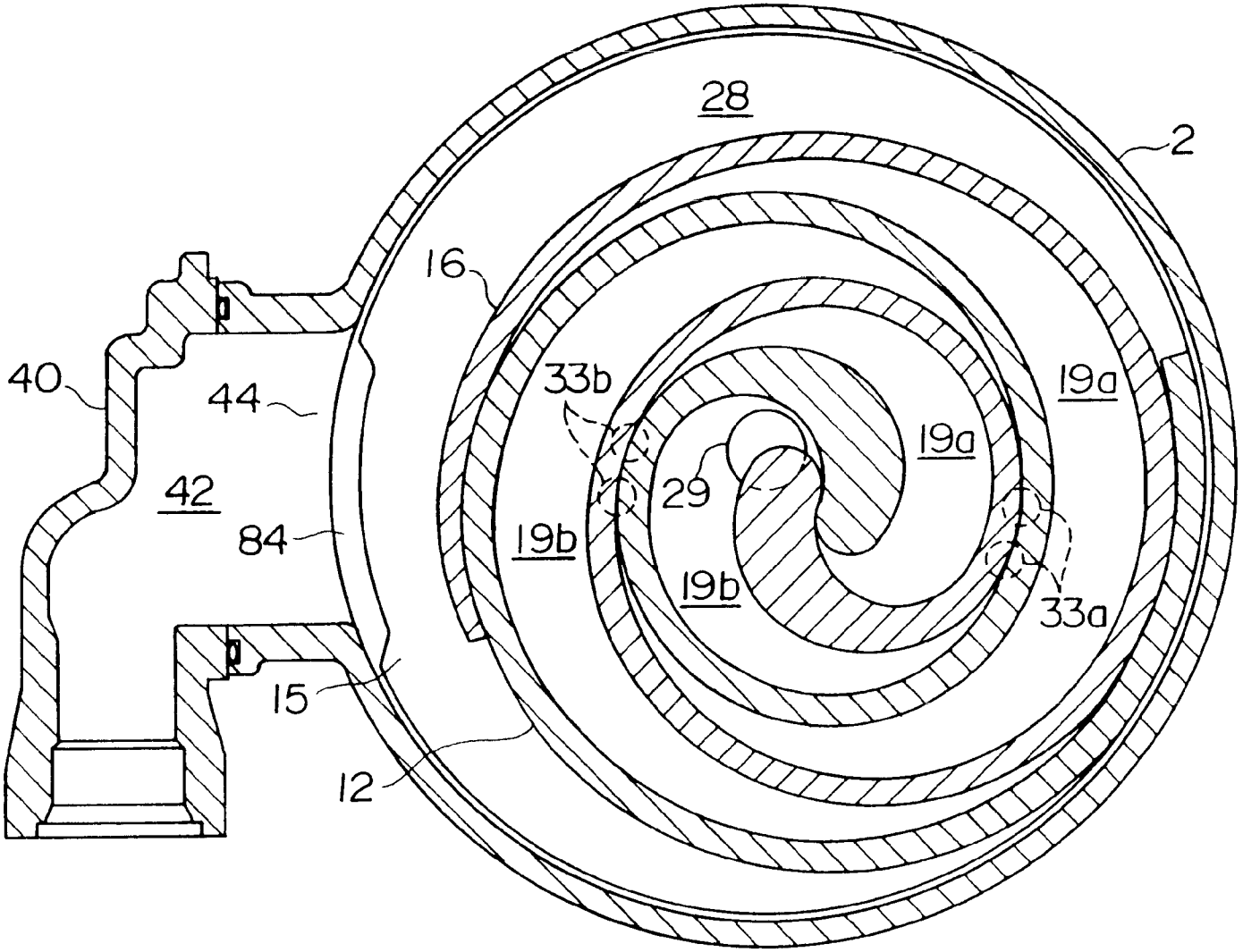
FIG. 5 is a sectional view along line "B—B" in FIG. 4.
Figure 6:
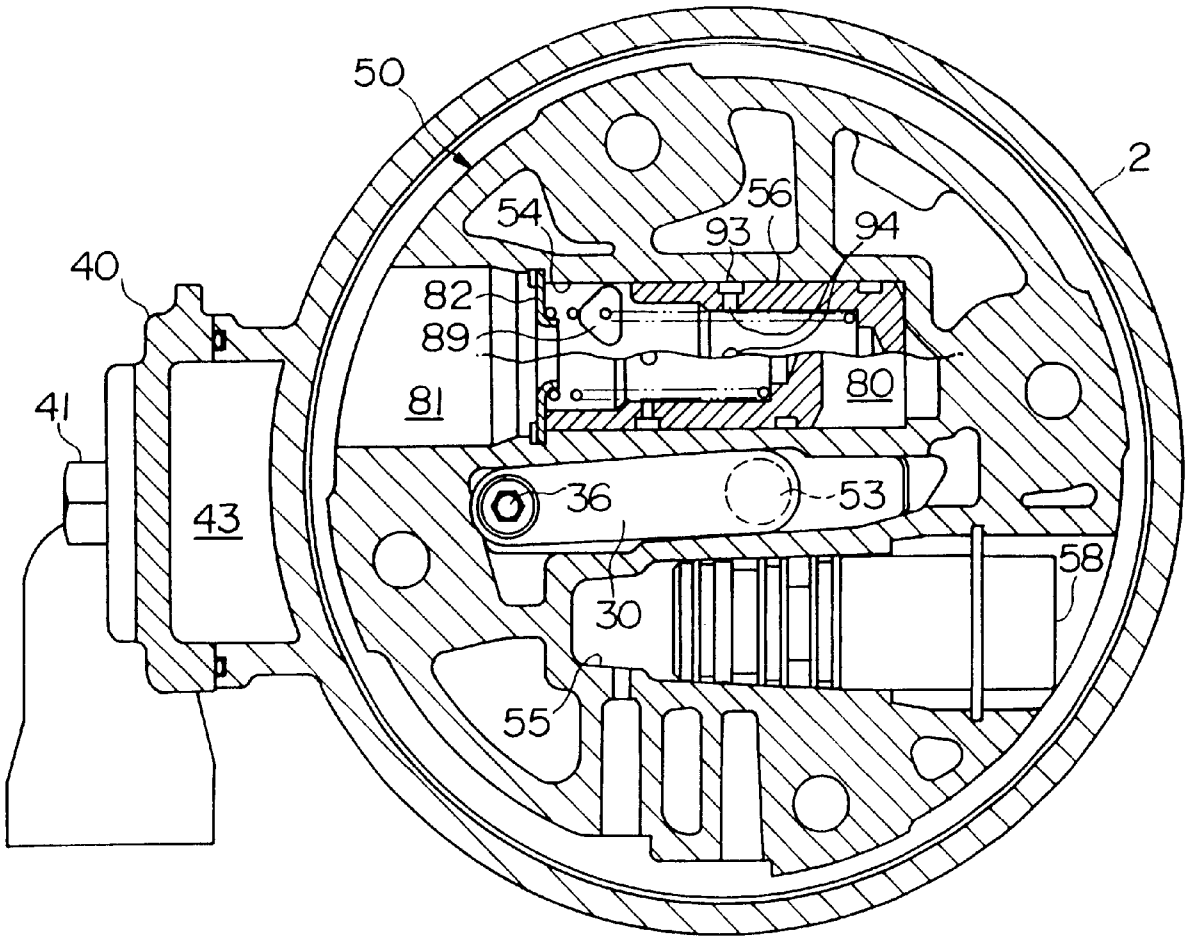
FIG. 6 is a sectional view along line "C—C" in FIG. 4.

The second embodiment of the present invention is shown in FIGS. 4–6. FIG. 4 is a sectional view in the longitudinal direction, FIG. 5 is a sectional view along line "B—B" in FIG. 4, and FIG. 6 is a sectional view along line "C—C" in FIG. 4.

The second embodiment has an arrangement similar to that of the first embodiment except for positions of gas-suction inlet 44 and relevant elements joined or connected therewith. In FIGS. 4–6, parts which are identical or have identical functions to those shown in FIG. 1–3 are given identical reference numbers.

In the present embodiment, piping fitting 40 is fastened to a lower portion of cup-like main body 2 via bolt 41, and gas-suction path 42 and gas-discharge path 43 are limited between the piping fitting 40 and the outer-peripheral surface at the lower side of the cup-like main body 2.

Therefore, at the time of a non-loading operation of the compressor, a low pressure for control is generated via the control valve 58. When this control pressure is introduced into control pressure chamber 80, piston 56 receives the restoring force of coil spring 83 and is forced and positioned as shown in FIG. 4.

Full-loading and non-loading operations of the compressor in the present embodiment are similar to those of the first embodiment.

Here, when the capacity is controlled, a high-temperature bypassing gas flows through chamber 81 of cylinder 56 into low-pressure chamber 28. Therefore, if the main stream of the bypassing gas and the gas-suction inlet 44 are distant from each other in the housing, the temperature of portions of fixed and revolving scrolls 10 and 14 neighboring the main stream of the bypassing gas is increased and the portions thermally expand; thus, the gap between the head of the relevant portion of spiral lap 12 and the inner surface 15*a* of end plate 15, and also the gap between the head of the relevant portion of spiral lap 16 and the inner surface 11*a* of end plate 11, that is, tip gaps become smaller than those of other portions, as explained in the first embodiment.

However, in the present embodiment, the gas-suction inlet 44 is provided near the main stream of the bypassing gas; thus, increase in the temperature of an area neighboring the main stream of the bypassing gas can be suppressed by using low-temperature suction gas which is suctioned from the gas-suction inlet 44.

Accordingly, when the capacity is controlled, it is possible to prevent the tip gap near the main stream of the bypassing gas from decreasing in comparison with the tip gaps of other areas; thus, scuffing can be prevented between the head of spiral lap 12 and the inner surface 15*a* of end plate 15, and also between the head spiral lap 16 and the inner surface 11*a* of end plate 11.

What is claimed is:

1. A capacity-controlled scroll compressor having an internally-bypassing system, the compressor comprising a housing, scrolls, and a gas-suction inlet, wherein:

the gas-suction inlet is positioned at a low-pressure side inside the housing; and lengths of teeth of a portion of the scrolls, which is closer to the gas-suction inlet, is shorter than those of teeth of other portions of the scrolls.

2. A capacity-controlled scroll compressor having an internally-bypassing system, the compressor comprising scrolls, wherein:

lengths of teeth of a portion of the scrolls, which is close to the main stream of a bypassing gas, is shorter than those of teeth of other portions.

3. A capacity-controlled scroll compressor as claimed in claim 1, wherein a target portion for shortening the teeth is of a hardening-processed scroll of the scrolls.

4. A capacity-controlled scroll compressor as claimed in claim 2, wherein a target portion for shortening the teeth is of a hardening-processed scroll of the scrolls.

* * * * *